US007832323B1

(12) United States Patent
Davies

(10) Patent No.: US 7,832,323 B1
(45) Date of Patent: Nov. 16, 2010

(54) FIREARM SUPPRESSOR

(76) Inventor: Robert B. Davies, 433 E. McKinley St., Tempe, AZ (US) 85281-1026

( * ) Notice: Subject to any disclaimer, the term of this patent is extended or adjusted under 35 U.S.C. 154(b) by 241 days.

(21) Appl. No.: 11/962,412

(22) Filed: Dec. 21, 2007

(51) Int. Cl.
*F41A 21/34* (2006.01)

(52) U.S. Cl. ..... 89/14.4

(58) Field of Classification Search ..... 89/14.3, 89/14.4, 14.2, 14.1, 14.5, 14.6
See application file for complete search history.

(56) References Cited

U.S. PATENT DOCUMENTS

| | | | | | |
|---|---|---|---|---|---|
| 2,112,831 | A * | 4/1938 | Cutts, Jr. | 89/14.3 |
| 2,216,653 | A * | 10/1940 | Sauer | 181/262 |
| 2,351,037 | A * | 6/1944 | Green | 89/14.5 |
| 2,448,593 | A * | 9/1948 | Heising | 89/14.2 |
| 2,780,962 | A * | 2/1957 | Ressler et al. | 89/14.2 |
| 2,798,569 | A * | 7/1957 | Fischer, Jr. | 181/252 |
| 2,872,848 | A * | 2/1959 | Schuessler | 89/14.3 |
| 3,399,597 | A * | 9/1968 | Perrine | 89/14.4 |
| 3,409,232 | A * | 11/1968 | Cholin | 239/499 |
| 3,667,570 | A * | 6/1972 | WerBell, III | 181/223 |
| 3,786,895 | A * | 1/1974 | Perrine | 181/223 |
| 4,576,083 | A * | 3/1986 | Seberger, Jr. | 89/14.4 |
| 4,907,488 | A * | 3/1990 | Seberger | 89/14.4 |
| 5,136,923 | A * | 8/1992 | Walsh, Jr. | 89/14.2 |
| 5,164,535 | A * | 11/1992 | Leasure | 89/14.4 |
| 6,308,609 | B1 | 10/2001 | Davies | |
| 6,374,718 | B1 * | 4/2002 | Rescigno et al. | 89/14.4 |
| 6,575,074 | B1 * | 6/2003 | Gaddini | 89/14.4 |
| 6,848,538 | B2 * | 2/2005 | Shafer | 181/223 |
| 7,594,464 | B2 * | 9/2009 | Dueck | 89/14.4 |
| 2007/0266844 | A1 * | 11/2007 | Dueck | 89/14.4 |

* cited by examiner

*Primary Examiner*—Bret Hayes
*Assistant Examiner*—Reginald Tillman, Jr.

(57) ABSTRACT

A suppressor for use with a firearm having a barrel with a muzzle and a bore, the suppressor includes an outer casing having a rearward end and a forward end, an evacuator assembly for receiving the muzzle of the firearm carried by the outer casing, and an expansion chamber defined between the outer casing and the evacuator assembly in gaseous communication with an interior volume of the evacuator assembly.

17 Claims, 8 Drawing Sheets

FIREARM SUPPRESSOR

FIELD OF THE INVENTION

This invention relates to firearms.

More particularly, the present invention relates to suppressors for reducing muzzle blast in firearms.

BACKGROUND OF THE INVENTION

It is well known in the field of firearms to modify barrels to compensate for various effects of firing a projectile using propellant gasses generated from the combustion of a propellant. Some of the effects are muzzle jump and/or recoil and muzzle blast. Each of these effects can be undesirable for reasons of accuracy, secrecy and general safety to the operator. Muzzle jump or recoil can adversely impact accuracy and reduce the rate of delivery of projectiles on target accurately. Muzzle blast is a loud noise and flash generally accompanying the discharge of a firearm. The combusted propellant gasses leaving the muzzle behind the projectile produce a loud bang and a flash. The noise can be damaging to the operator or nearby individuals not wearing ear protectors and can bring unwanted attention in instances of covert use. The flash also can adversely affect night vision and draw unwanted attention to the use of the firearm.

Attempts to ameliorate these problems in the past have resulted in many devices which are attached to the muzzle end of the barrel of a firearm. Included in these devices are muzzle brakes and suppressors/silencers. Muzzle brakes have been used in the past to reduce the recoil action of a gun when it is fired. Muzzle brakes employ the forward momentum of a pressure wave produced by expanding propellant gas upon detonation of a cartridge. By deflecting some of such propellant gas in a suitable manner, a forward impulse is generated on the brake and hence the barrel of the firearm. This forward impulse balances, to some degree, the recoil impulse on the barrel of the firearm. These devices, however, have little or no affect on the muzzle blast.

Suppressors/silencers have been developed specifically to deal with muzzle blast. Suppressors/silencers redirect and disperse the burnt or burning propellant gasses. By dispersing the gasses, a sharp muzzle blast noise is blurred and muted to produce a much softer sound. This is typically accomplished by employing a series of chambers distributed serially in a cylindrical canister attached to the muzzle of the firearm. As the projectile leaves the muzzle, the propellant gasses are temporarily received by the consecutive chambers. The gasses escape from the chambers, as the projectile leaves the canister, in a dispersed and delayed manner, reducing the noise generated. While effective, the released gasses will escape out both ends of the canister. The gasses entering back down the barrel are often referred to as blow back or back pressure. During the cycling of the firing mechanism, such as a bolt carrier in automatic small arms, back pressure can result in propellant gasses carrying combusted and un-combusted propellant particles and residue back into the mechanism. This can adversely affect the operation of the firearm by leaving deposits which can result in jamming of the action and potentially endangering the operator.

It would be highly advantageous, therefore, to remedy the foregoing and other deficiencies inherent in the prior art.

Accordingly, it is an object of the present invention to provide a new and improved suppressor/silencer for firearms.

Another object of the invention is to provide a suppressor/silencer with greatly reduced muzzle blast.

And another object of the invention is to provide a suppressor/silencer with reduced or no back pressure.

SUMMARY OF THE INVENTION

Briefly, to achieve the desired objects of the instant invention in accordance with an embodiment thereof, provided is a suppressor for use with a firearm having a barrel with a muzzle and a bore. The suppressor includes an outer casing having a rearward end and a forward end, an evacuator assembly for receiving the muzzle of the firearm carried by the outer casing, and an expansion chamber defined between the outer casing and the evacuator assembly in gaseous communication with an interior volume of the evacuator assembly.

In a specific aspect, the evacuator assembly includes a nozzle having a rearward end for receiving and engaging the muzzle of the firearm and a forward end having a bore for alignment with the bore of the firearm, an evacuator defining a central chamber at a rearward end thereof and a bore extending forwardly through a forward end thereof, and a plurality of slots formed in the evacuator proximate the rearward end establishing gaseous communication between the central chamber of the evacuator and the expansion chamber. The nozzle is received within the central chamber of the evacuator and positioned with the bore at the forward end of the nozzle extending forwardly past the plurality of slots formed in the evacuator.

In yet another aspect, a baffle assembly includes a baffle casing having a rearward end and a forward end, a plurality of baffle elements stacked within the baffle casing from proximate the forward end to the rearward end, each baffle element having an aperture centrally therethrough, and the rearward end coupled to the baffle cover. An expansion volume is defined between the baffle casing and the outer casing. A baffle cover includes a radially outwardly directed flange engaging the outer casing and holding the baffle casing centrally within the outer casing. The flange includes a plurality of apertures therethrough establishing gaseous communication between the expansion chamber and the expansion volume.

In a further aspect, the suppressor includes a coupling assembly carried by the outer casing proximate the rearward end thereof, the coupling assembly including a barrel receptacle having a forward end in engagement with the rearward end of the nozzle, the barrel receptacle defining an interior volume shaped to receive the muzzle therethrough and support the barrel therein. A support collar engages the rearward end of the nozzle, the support collar retaining the rearward end of the evacuator assembly and the forward end of the barrel receptacle centrally within the outer casing.

In another aspect, a firearm is provided. The firearm includes a barrel with a muzzle and a bore therethrough, and a suppressor coupled to the muzzle of the firearm. The suppressor includes an outer casing having a rearward end closed by a rearward end cap having an aperture therethrough and a forward end closed by a forward end cap. An evacuator assembly and a baffle assembly are carried by the outer casing and coupled in line between the rearward end cap and the forward end cap. An expansion chamber is defined between the outer casing and the evacuator assembly in gaseous communication with an interior volume of the evacuator assembly and the bore of the firearm. The evacuator assembly includes a nozzle having a rearward end receiving and engaging the muzzle of the firearm and a forward end having a bore aligned with the bore of the firearm. The evacuator assembly also includes an evacuator defining a central chamber at a rearward end thereof and a bore extending forwardly through a forward end thereof, and a plurality of slots formed in the evacuator proximate the rearward end establishing gaseous communication between the central chamber of the evacuator and the expansion chamber.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
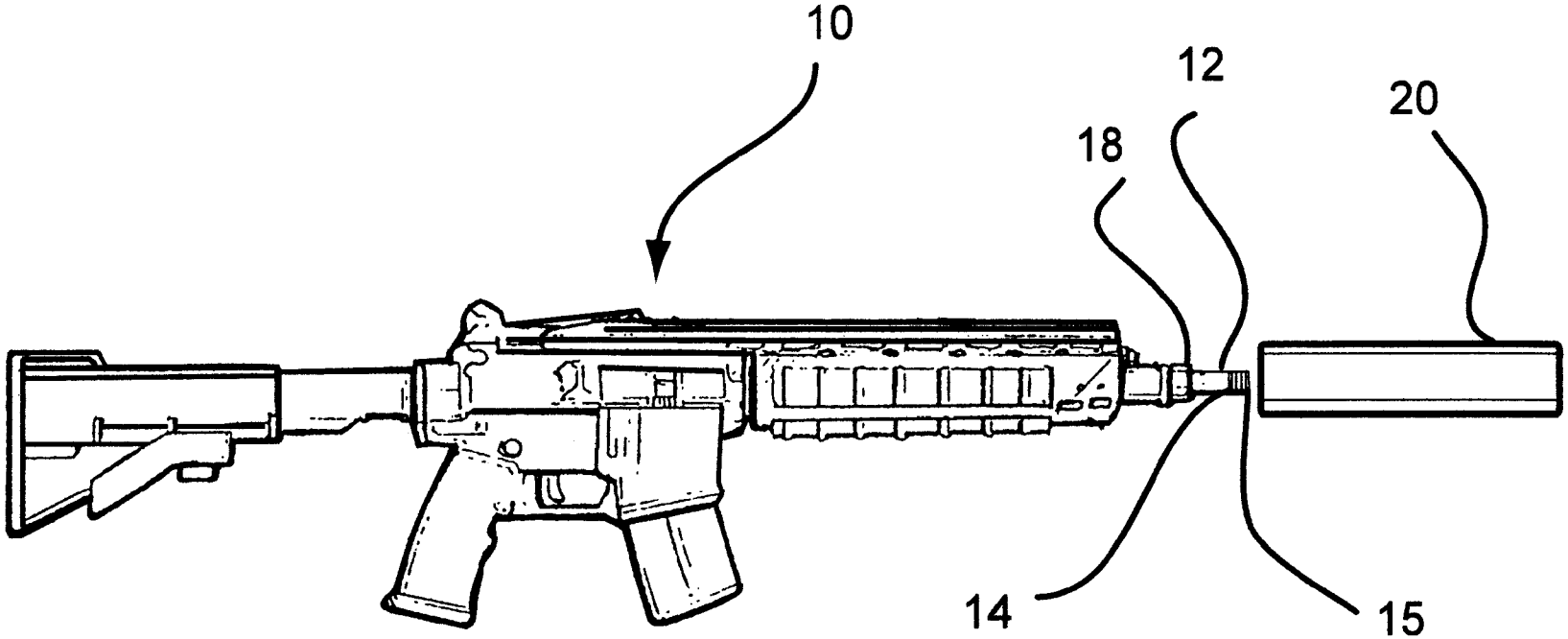
FIG. 1 is a perspective view illustrating a firearm with a suppressor according to the present invention attached thereto.

Turning now to the drawings in which like reference characters indicate corresponding elements throughout the several views, attention is first directed to FIG. 1, which illustrates a firearm 10 including a barrel 12 having a muzzle 14 and a bore 15. A suppressor 20, according to the present invention, is coupled to muzzle 14 of firearm 10. Firearm 10 includes substantially any small arms, such as bolt action rifles, automatic and semiautomatic rifles, and heavier firearms such as machines guns and the like. Substantially any firearm with a barrel having a muzzle and propelling a projectile therefrom with combusted propellant gasses can employ suppressor 20.

Figure 2:
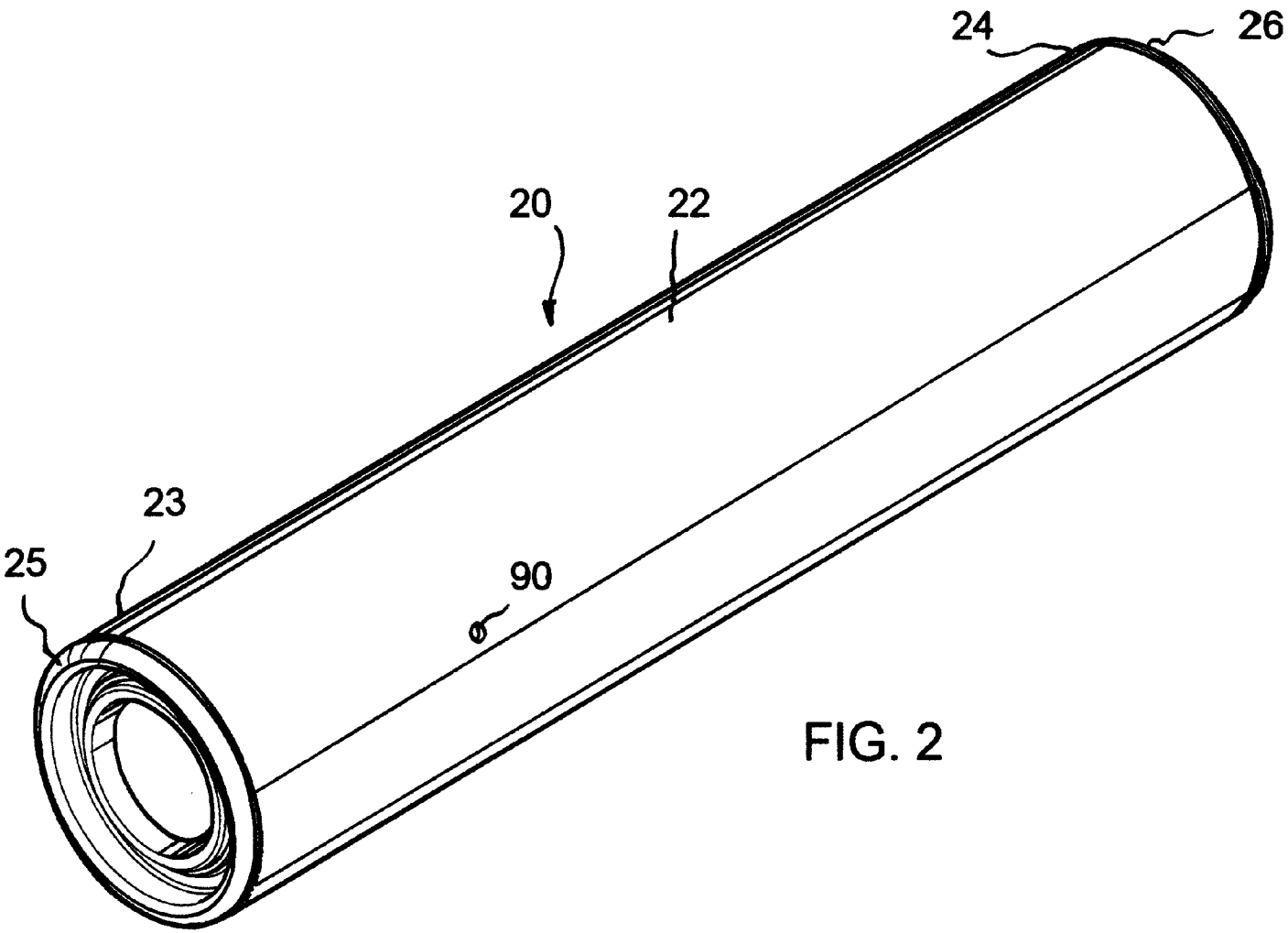
FIG. 2 is a perspective view of the suppressor according to the present invention.

Referring now to FIG. 2, suppressor 20 includes an outer casing 22 having a rearward end 23 and a forward end 24. For purposes of this description, the term rearward is a direction toward the firearm, and the term forward is a direction away from the firearm. A rearward end cap 25 and forward end cap 26 close rearward end 23 and forward end 24, respectively, and contain a coupling assembly, an evacuator assembly, and a baffle assembly within outer casing 22, which will described in detail herein. Outer casing 22 is tubular and preferably fashioned of a durable lightweight material. The material used can include metals such as steel, titanium, and aluminum or composites such as carbon fiber, graphite, ceramic and the like. As can be seen, rearward end cap 25 includes an aperture for receiving muzzle 14 of barrel 12.

Figure 3:
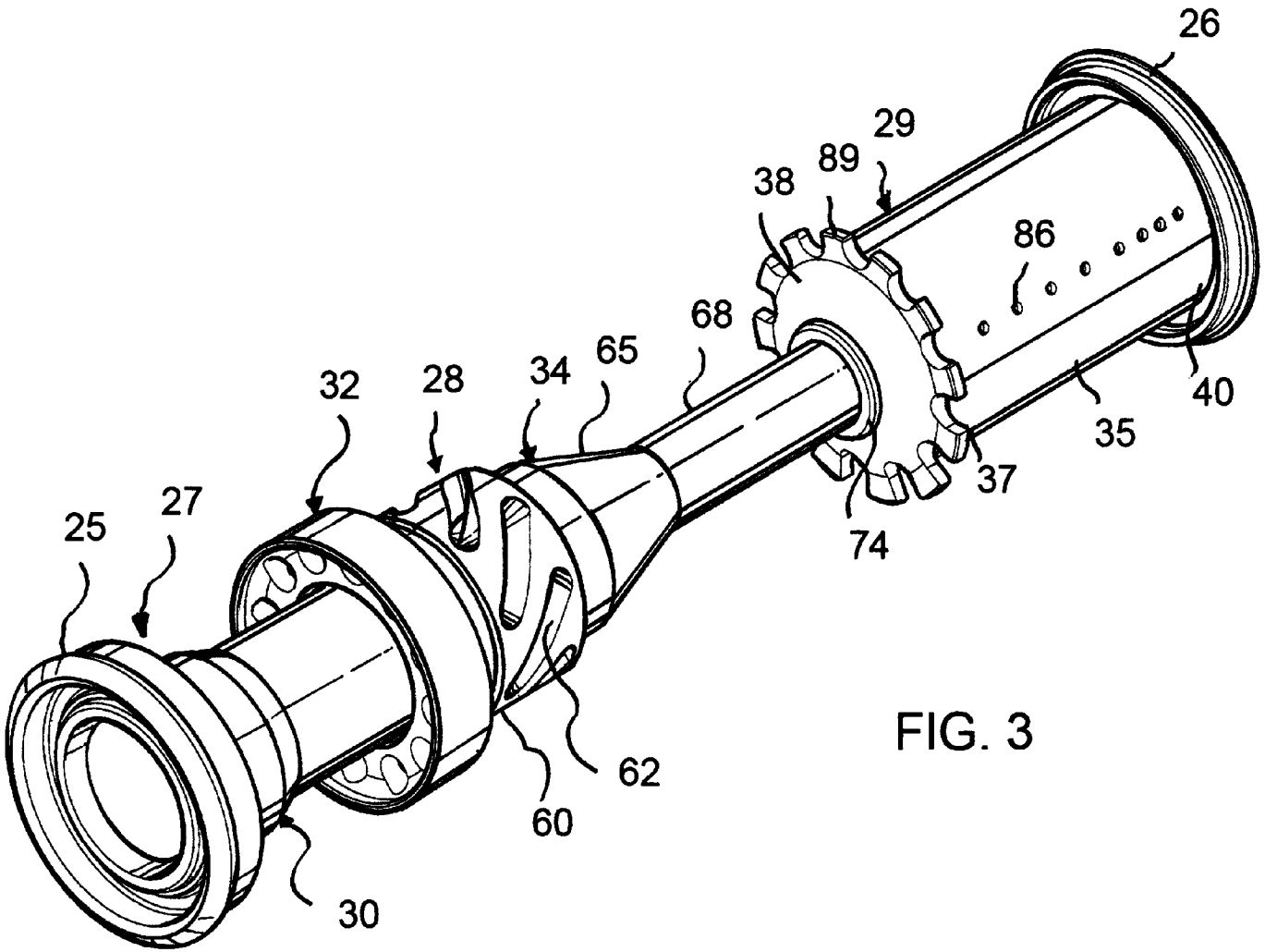
FIG. 3 is a perspective view of the suppressor of FIG. 2 with the outer casing removed.
Figure 4:
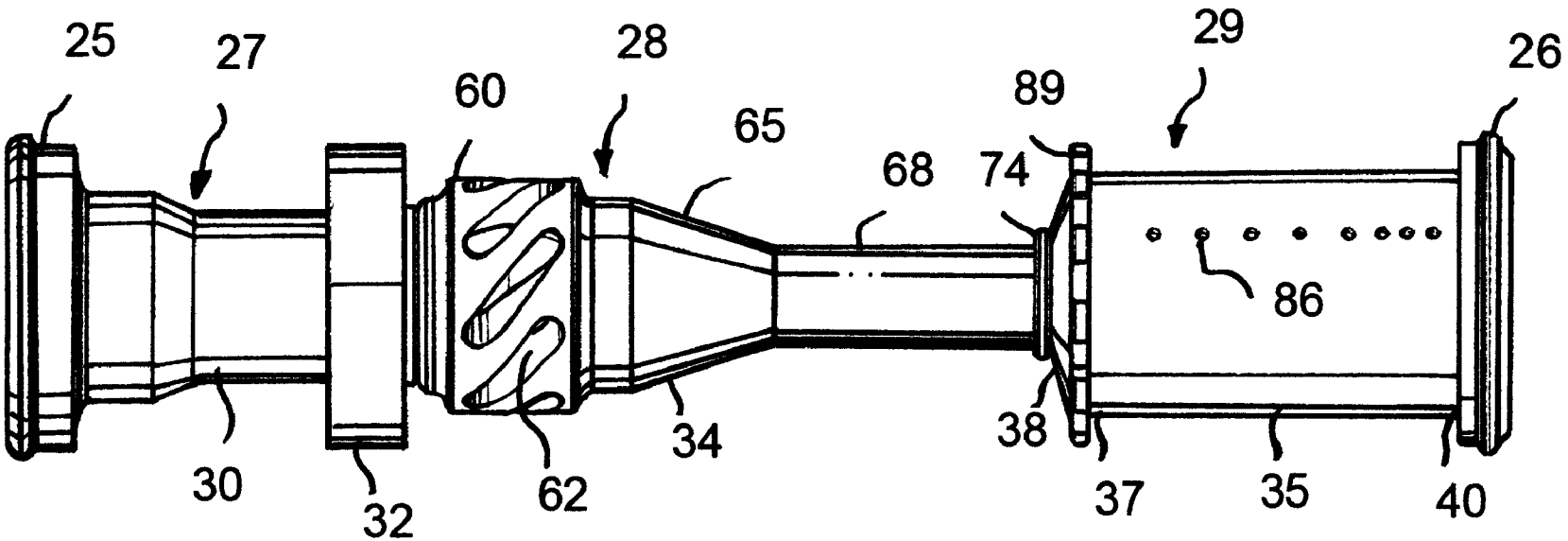
FIG. 4 is a side view of suppressor of FIG. 2 with the outer casing removed.
Figure 7:
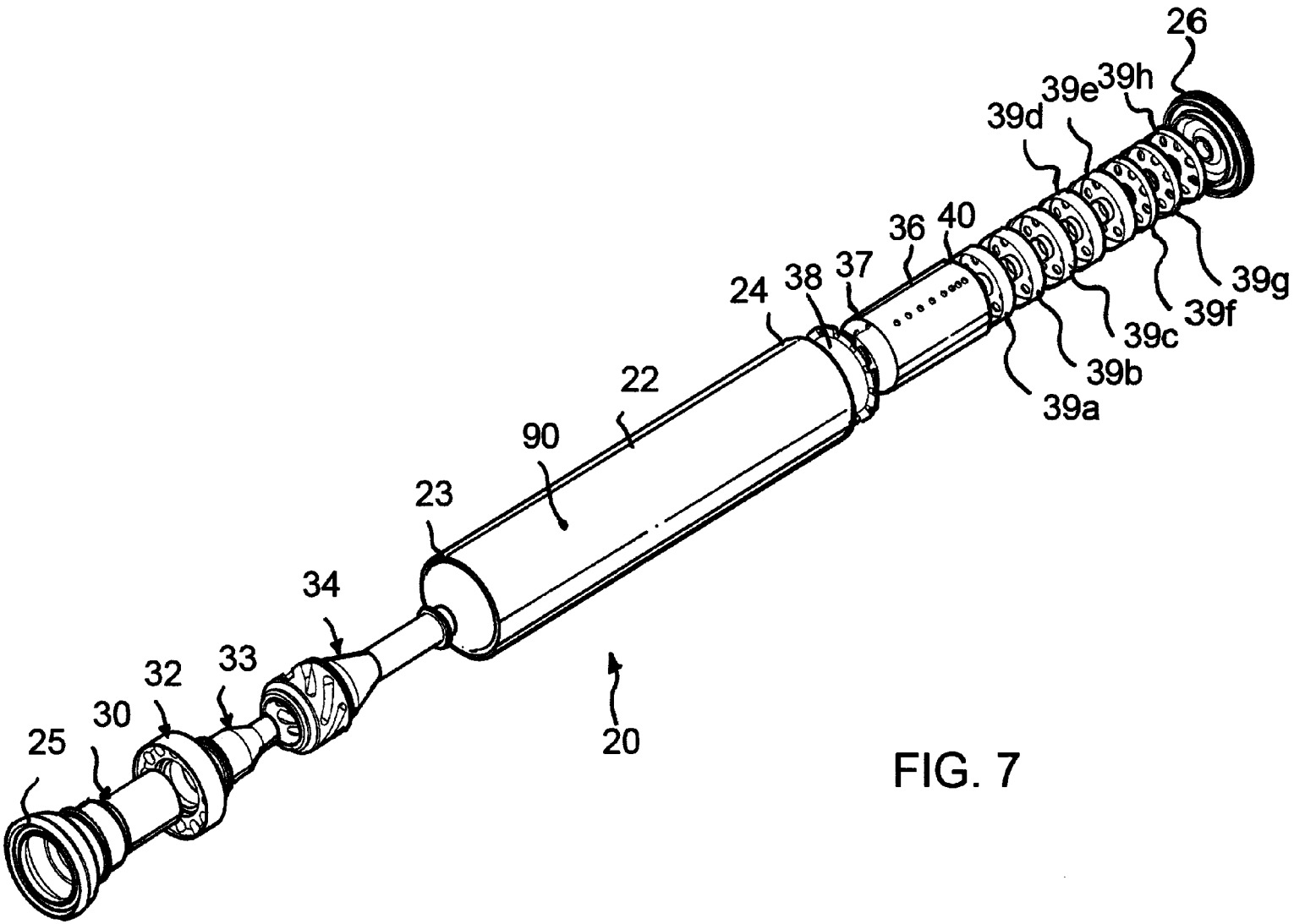
FIG. 7 is a exploded perspective view of the suppressor of FIG. 2.
Figure 8:
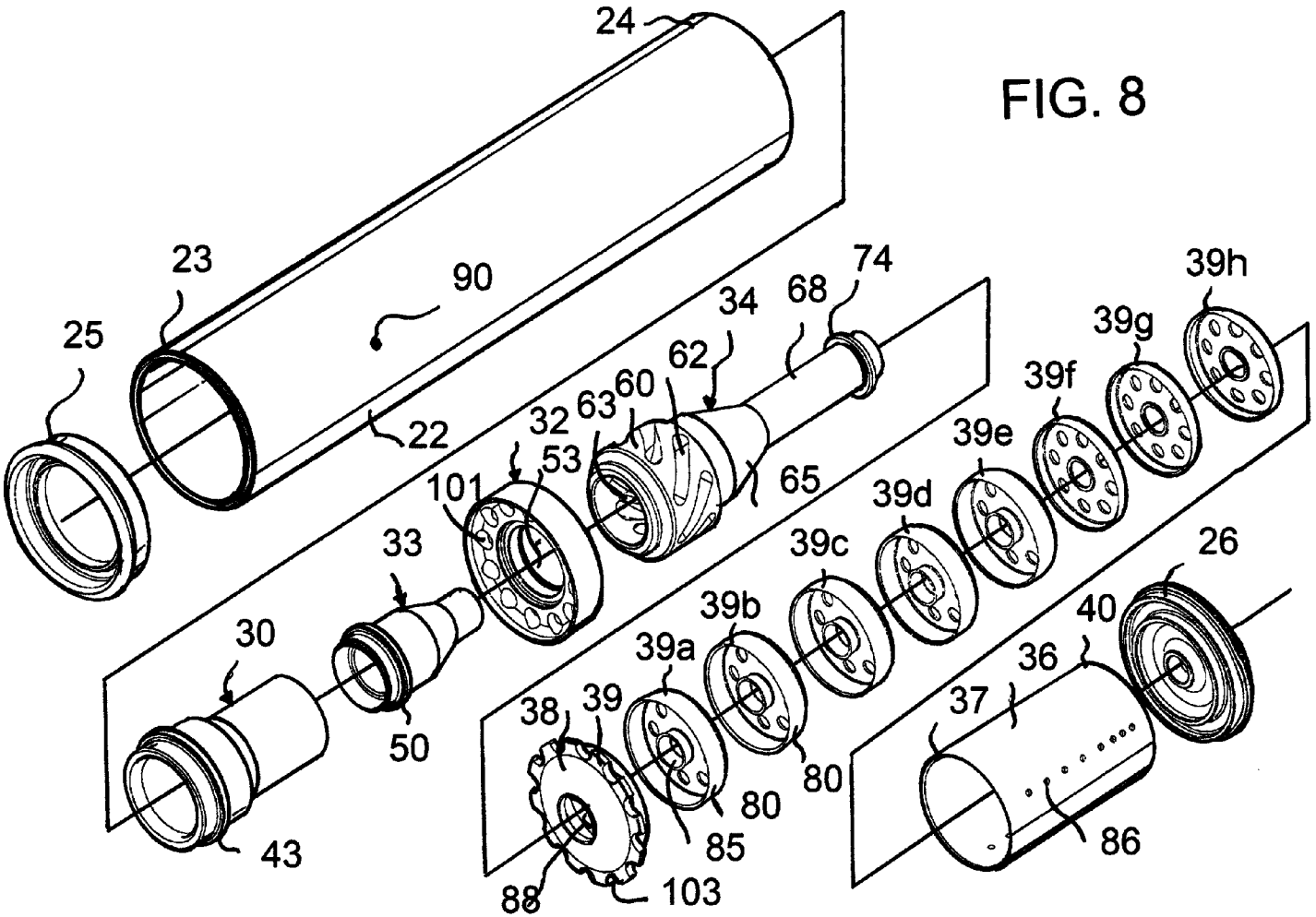
FIG. 8 is an exploded perspective view of the suppressor of FIG. 2.

Referring now to FIGS. 3 and 4, suppressor 20 is illustrated with outer casing 22 removed to show in linear arrangement, a coupling assembly 27, an evacuator assembly 28, and a baffle assembly 29 positioned between rearward end cap 25 and forward end cap 26. With additional reference to FIGS. 7 and 8, coupling assembly 27 includes a barrel receptacle 30 and a support collar 32. Evacuator assembly 28 includes a nozzle 33 and an evacuator 34. Baffle assembly 29 includes a baffle casing 35 having a rearward end 37 closed by a baffle cover 38, a plurality of baffle elements 39*a-h* and a forward end 40 received by forward end cap 26. It should be noted that suppressor 10 is cylindrical with an outer diameter defined by the outer surface of outer casing 22, and a central bore (defined by various elements each contributing to create the central bore) extending co-axially through the entire suppressor as will be described presently.

Coupling assembly 27 receives barrel 12 therethrough and acts to stabilize suppressor 20 with respect to barrel 12. With additional reference to FIGS. 5 and 6, barrel receptacle 30 has a rearward end coupled to rearward end cap 25 and a forward end. Barrel receptacle 30 is generally cylindrical and includes a beveled shoulder 42 reducing the inner diameter thereof intermediate the rearward end and the forward end thereof. The inner diameter of barrel receptacle 30 rearward of beveled shoulder 42 is greater than the inner diameter of barrel receptacle 30 forward of beveled shoulder 42 so as to facilitate alignment of and insertion of muzzle 14. A radially outwardly directed lip 43 encircles barrel receptacle 30 proximate its rearward end and engages an inner surface of rearward end cap 25 as the rearward end of barrel receptacle 30 extends through a central aperture thereof.

Evacuator assembly 28 acts to redirect a portion of the propellant gasses and prevent back pressure in the barrel while dispersing much of the energy of the propellant gasses as will be described presently. Nozzle 33 of evacuator assembly 28 has a rearward end received in the forward end of barrel receptacle 30, and a forward end. Nozzle 33 is generally cylindrical and includes a beveled shoulder 45 intermediate the rearward end and the forward end thereof, reducing the outer diameter of nozzle 33 forward of beveled shoulder 45. A shoulder 47 also divides the inner surface of nozzle 33 intermediate the rearward end and the forward end into a rearward inner surface having a diameter greater than a forward inner surface. Forward inner surface defines a bore 48 of sufficient size to receive a projectile fired from muzzle 14. The rearward inner surface is threaded, in this embodiment, to form an engagement element for attachment of muzzle 14 which is threaded as a complemental attachment element. It should be noted, with particular reference to FIG. 6, that the shape of barrel receptacle 30 and nozzle 33 is such that barrel 12 can be inserted therein and threaded into the rearward inner surface of nozzle 33 so that a bore of firearm 10 is aligned with bore 48. A registration surface 46 engages a registration surface 18 on barrel 12, well known in the art, providing proper seating and stability. It will be understood that various other shapes can be employed for barrel receptacle 30 and nozzle 33 so as to conform to the shape of a barrel to be inserted therein and provide adequate contact and support. A radially outwardly directed lip 50 encircles nozzle 33 proximate the rearward end thereof and abuts the forward end of barrel receptacle 30.

Support collar 32 has a central opening 53 defined by an inner wall 55 having a notch 57 formed therein and extending from a rearward end thereof to a point spaced from a forward end thereof. Nozzle 33 is received through central opening 53 from the rearward side to the forward side, with lip 50 engaging notch 57. The rearward end of nozzle 33 is then positioned in the forward end of barrel receptacle 30. Insertion of nozzle 33 into barrel receptacle 30 is limited by lip 50. Evacuator 34 includes a generally cylindrical portion 60 having a plurality of helical slots 62 formed through the sides thereof in communication with a central chamber 63. A rearward end of cylindrical portion 60 is open to receive nozzle 33 therein and a conical portion 65 extends from a forward end of cylindrical portion 60. Conical portion 65 terminates in a shaft portion 68 having a central bore 69. Conical portion 65 includes an interior volume 70 having a diameter substantially the same as a diameter of central chamber 63 with which it joins, and constricts to a diameter substantially the same as the diameter of central bore 69 of shaft portion 68. The rearward end of cylindrical portion 60 engages the forward face of inner wall 55 of support collar 32. A lip 74 encircles shaft portion 68 spaced from the forward end thereof. Forward end of shaft portion 68 is received by baffle cover 38 of baffle assembly 29.

Baffle assembly 29 is generally assembled prior to positioning in outer casing 22. Baffle casing 36 is cylindrical and receives baffles 39*a-h* in a stacked arrangement therein. Each baffle 39*a-h* includes a sidewall 80 extending generally perpendicularly from a face 82 in the rearward direction. Face 82 is sloped slightly from a perimeter edge inwardly to a central aperture 84. Inner sidewalls 85 extend rearwardly from a perimeter of central aperture 84 with a slightly outward flare. The central apertures of the baffles align along the axis of suppressor 20 contributing to the before mentioned axial bore, and have a diameter sufficient to permit a projectile from firearm 10 to pass therethrough without hinderance. Baffles 39 divide baffle assembly 29 into a plurality of expansion chambers 86 which collect propellant gasses as the projectile passes. The collected gasses are attenuated within chambers 86 muffling and dispersing the energy of the muzzle blast. Various methods can be employed to secure the baffles 39 to baffle casing 36. In this embodiment, apertures 86 are formed in baffle casing 36 to permit a spot weld to be formed between casing 36 and sidewall 80 of each baffle 39. In this manner, each baffle can be accurately positioned and held securely. Baffle cover 38 is fitted onto rearward end 37 of casing 36 and has a central aperture 88 in alignment with central aperture 84 of baffles 39. When baffle assembly 29 is positioned within forward end 24 of casing 22, central aperture 88 of baffle cover 38 receives forward end of shaft portion 68. Insertion of forward end of shaft portion 68 is limited by lip 74 which engages an outer surface of baffle cover 38. Baffle cover 38 also includes a flange 89 extending radially outwardly therefrom, sized to engage the inner surface of outer casing 22. In this manner, baffle cover 38 maintains a central positioning of the forward end of shaft portion 68 and rearward end of baffle assembly 29 within outer case 22. Thus, support collar 32 and baffle cover 38 support coupling assembly 27, evacuator assembly 28, and baffle assembly 29 centrally within casing 22.

Each of the elements of Suppressor 20 are engaged with one another along the length of outer casing 22 and clamped between rearward end cap 25 and forward end cap 26 which can be fastened to casing 22 in various manners such as by using adhesives, welding, brazing, use of fasteners such as screws and the like, etc. Once assembled in this manner each element engages adjacent elements as described and coupling assembly 27, evacuator assembly 28, and baffle assembly 29 are securely fixed relative each other and casing 22. Support collar 32 securely supports evacuator assembly 28 centrally within casing 22 so as to maintain the bore extending axially along suppressor 20. Support collar 32 is preferably positioned and retained by a spot weld between an outer surface thereof and the casing. The spot weld can be formed by pre-positioning of an aperture 90 formed through outer casing 22.

Figure 5:
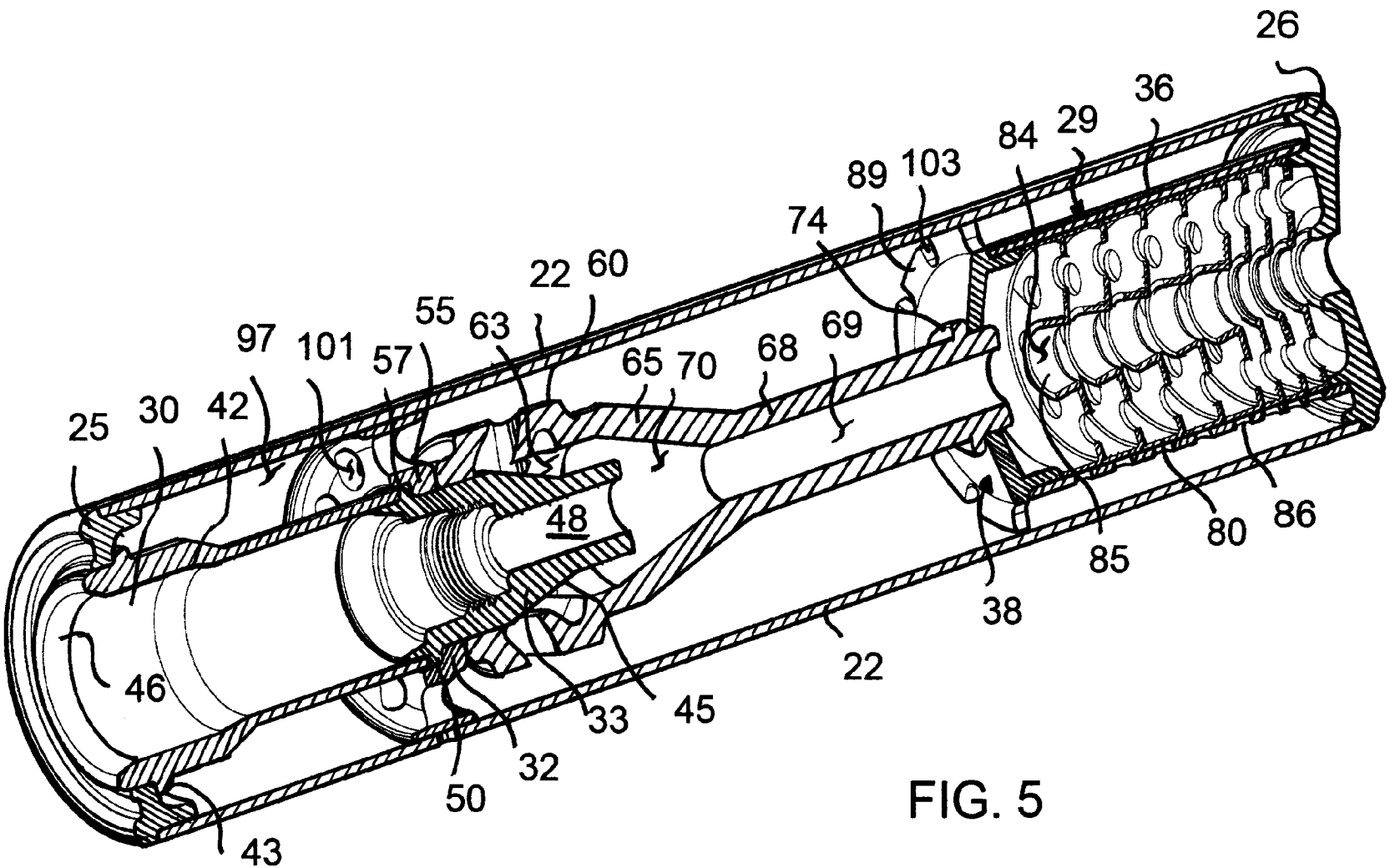
FIG. 5 is a sectional perspective view of the suppressor as seen from the line 5-5 of FIG. 2.
Figure 6:
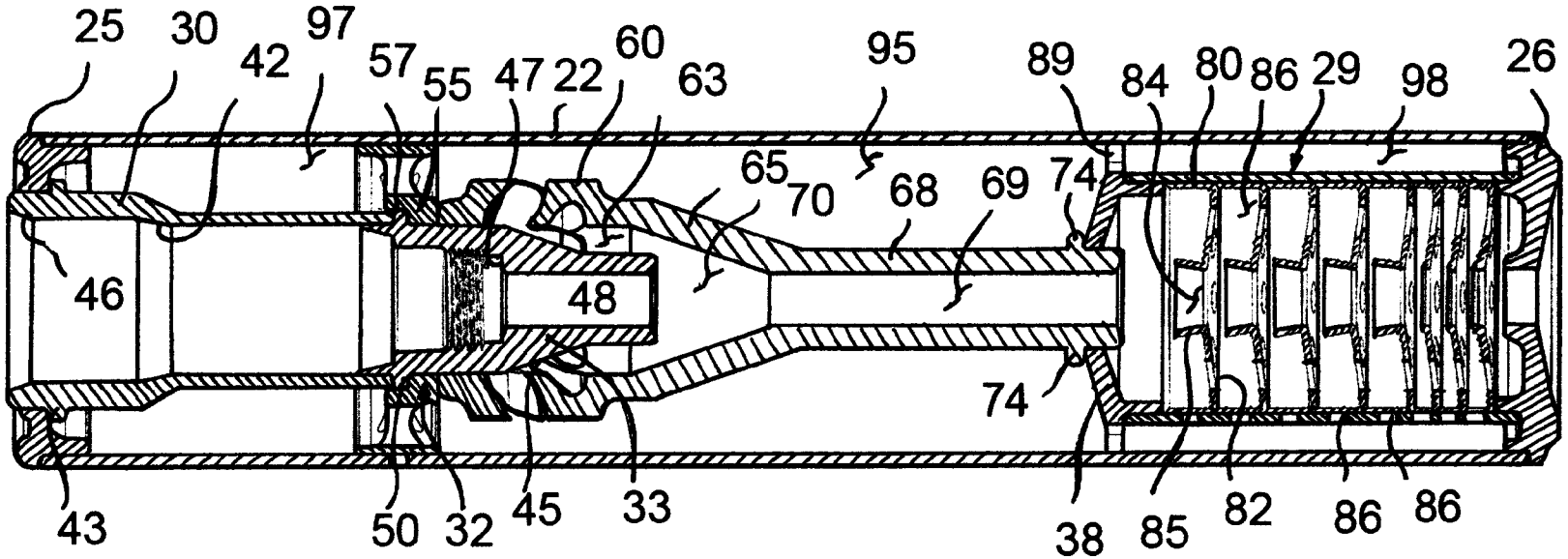
FIG. 6 is a side view of the sectional perspective view of FIG. 5.

Referring specifically to FIGS. 5 and 6, support collar 32 maintains evacuator assembly 28 centrally within casing 22. In this manner, an expansion chamber 95 is formed between evacuator 34 and casing 22. Expansion chamber 95 is extended, in this embodiment, rearwardly to a volume 97 formed between barrel receptacle 30 and casing 22, and forwardly to a volume 98 formed between baffle assembly 29 and casing 22. Volume 97 is in gaseous communication with expansion chamber 95 by the formation of a plurality of openings 101 formed through support collar 32. Volume 98 is in gaseous communication with expansion chamber 95 by the formation of a plurality of openings 103 formed through flange 89 of baffle cover 38. It will be understood by one skilled in the art that expansion chamber 95 can be used alone, without volumes 97 and 98. Additionally, it should be mentioned here that suppressor 20 can be formed without coupling assembly 27. Coupling assembly 27 provides stability and support to the joining of suppressor 20 and firearm 10. However, it is anticipated that muzzle 14 may be inserted directly into nozzle 33. In this case, support collar 32 would be replaced with a rearward end cap, and casing 22 would terminate at that point.

In operation, suppressor 20 dissipates propellant gasses from the muzzle blast, and also prevents gasses from being forced back down the barrel. As a projectile exits muzzle 14 and passes through and exits bore 48, propellant gasses enter volume 70 and pass through helical slots 62 into expansion chamber 95 and volumes 97 and 98. Gasses passing through helical slots 62 can generate torque on evacuator assembly 28 due to the shape of slots 62. When properly oriented to the handedness of the threads on muzzle 14, the torque can be used to maintain the engagement of muzzle 14 within nozzle 33. In other words, as a projectile is fired, forces act to further thread the suppressor onto the barrel as opposed to unthreading the suppressor from the barrel. It should also be noted at this point, that helical slots 62 can be substantially any shape opening if this added benefit is not desired, such as when attachment means other than threading is employed. Additionally, these openings (helical slots 62) are specifically positioned rearward of forward end of nozzle 33. As the projectile passes through bore 69 propellant gasses are prevented from entering baffle assembly 29 and fill expansion chamber 95. As the projectile clears the forward end of shaft portion 68 and enters baffle assembly 29, propellant gasses can now escape into chambers 86 of baffle assembly 29. The propellant gasses captured within expansion chamber 95 now escape back through slots 62 and pass down the axial bore toward baffle assembly 29. As the gasses pass the forward end of nozzle 33, a Venturi effect is created at bore 48. Thus, back pressure is eliminated, and gasses still within barrel 12 can be pulled into suppressor 20. The Venturi effect results from the positioning of slots 62 rearward of forward end of nozzle 33 positioned within interior volume 70. In this manner, muzzle flash is first attenuated by the evacuator assembly and then by the baffle assembly.

To further reduce the energy of the propellant gasses, a liquid, such as water, can be carried within expansion chamber 95. Expansion chamber 95 is not filled, but a small quantity of liquid therein will absorb a great deal of energy. With a liquid within expansion chamber 95, if the temperature is higher than the boiling point of the liquid, a large amount of the energy (heat) will be expended changing the liquid from the liquid phase to the gas phase. Volume 97 also acts as a reservoir for the liquid when suppressor 20 is pointed upward. In this manner, liquid will not enter barrel 12.

Thus, a new and improved suppressor is disclosed that disperses propellant gases greatly reducing muzzle flash. Also, back pressure is reduced or eliminated by forming a Venturi at the nozzle adjacent the muzzle of the firearm. By eliminating back pressure, safety to the operator is increased, and the use of suppressor of the present invention does not increase the wear and tear on or the fowling of the firearm.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A suppressor for use with a firearm having a barrel with a muzzle and a bore, the suppressor comprising:

an outer casing having a rearward end and a forward end;

an evacuator assembly for receiving the muzzle of the firearm carried by the outer casing;

an expansion chamber defined between the outer casing and the evacuator assembly; and the evacuator assembly including:

a nozzle having a rearward end for receiving and engaging the muzzle of the firearm and a forward end having a bore for alignment with the bore of the firearm;

an evacuator defining a central chamber at a rearward end thereof and a bore extending forwardly through a forward end thereof;

a plurality of slots formed in the evacuator proximate the rearward end establishing gaseous communication between the central chamber of the evacuator and the expansion chamber; and the nozzle is received within the central chamber of the evacuator and positioned with the bore at the forward end of the nozzle extending forwardly past the plurality of slots formed in the evacuator.

2. A suppressor as claimed in claim 1 further comprising a baffle assembly carried by the outer casing and coupled in line with and forward of the evacuation assembly.

3. A suppressor as claimed in claim 2 wherein the forward end of the evacuator is coupled to the baffle assembly by a baffle cover having an aperture centrally therethrough.

4. A suppressor as claimed in claim 3 wherein the baffle assembly includes a baffle casing having a rearward end and a forward end, a plurality of baffle elements stacked within the baffle casing from proximate the forward end to the rearward end, each baffle element having an aperture centrally therethrough, and the rearward end coupled to the baffle cover.

5. A suppressor as claimed in claim 4 wherein an expansion volume is defined between the baffle casing and the outer casing.

6. A suppressor as claimed in claim 5 wherein the baffle cover includes a radially outwardly directed flange engaging the outer casing and holding the baffle casing centrally within the outer casing.

7. A suppressor as claimed in claim 6 wherein the flange includes a plurality of apertures therethrough establishing gaseous communication between the expansion chamber and the expansion volume.

8. A suppressor as claimed in claim 1 further including a coupling assembly carried by the outer casing proximate the rearward end thereof, the coupling assembly including a barrel receptacle having a forward end in engagement with the rearward end of the nozzle, the barrel receptacle defining an interior volume shaped to receive the muzzle therethrough and support the barrel therein.

9. A suppressor as claimed in claim 8 wherein the coupling assembly further includes a support collar engaging the rearward end of the nozzle, the support collar retaining the rearward end of the evacuator assembly and the forward end of the barrel receptacle centrally within the outer casing.

10. A suppressor as claimed in claim 9 wherein an expansion volume is defined between the barrel receptacle and the outer casing.

11. A suppressor as claimed in claim 6 wherein the support collar includes a plurality of apertures therethrough establishing gaseous communication between the expansion chamber and the expansion volume.

12. A firearm comprising:

a firearm having a barrel with a muzzle and a bore therethrough;

a suppressor coupled to the muzzle of the firearm, the suppressor comprising:

an outer casing having a rearward end closed by a rearward end cap having an aperture therethrough and a forward end closed by a forward end cap;

an evacuator assembly carried by the outer casing;

an expansion chamber defined between the outer casing and the evacuator assembly in gaseous communication with an interior volume of the evacuator assembly and the bore of the firearm; and the evacuator assembly including a nozzle having a rearward end receiving and engaging the muzzle of the firearm and a forward end having a bore aligned with the bore of the firearm, an evacuator defining a central chamber at a rearward end thereof and a bore extending forwardly through a forward end thereof, and a plurality of slots formed in the evacuator proximate the rearward end establishing gaseous communication between the central chamber of the evacuator and the expansion chamber, the nozzle is received within the central chamber of the evacuator and positioned with the bore at the forward end of the nozzle extending forwardly past the plurality of slots formed in the evacuator.

13. A suppressor as claimed in claim 12 further comprising a baffle assembly includes a baffle casing having a rearward end and a forward end, a plurality of baffle elements stacked within the baffle casing from proximate the forward end to the rearward end, each baffle element having an aperture centrally therethrough, and the rearward end coupled to a baffle cover having an aperture centrally therethrough to which the forward end of the evacuator is coupled.

14. A firearm as claimed in claim 13 wherein an expansion volume is defined between the baffle casing and the outer casing and wherein the baffle cover includes a radially outwardly directed flange engaging the outer casing and holding the baffle casing centrally within the outer casing, the flange including a plurality of apertures therethrough establishing gaseous communication between the expansion chamber and the expansion volume.

15. A firearm comprising:

a firearm having a barrel with a muzzle and a bore therethrough;

a suppressor coupled to the muzzle of the firearm, the suppressor comprising:

an outer casing having a rearward end closed by a rearward end cap having an aperture therethrough and a forward end closed by a forward end cap;

an evacuator assembly carried by the outer casing;

an expansion chamber defined between the outer casing and the evacuator assembly in gaseous communication with an interior volume of the evacuator assembly and the bore of the firearm; and the evacuator assembly including a nozzle having a rearward end receiving and engaging the muzzle of the firearm and a forward end having a bore aligned with the bore of the firearm, an evacuator defining a central chamber at a rearward end thereof and a bore extending forwardly through a forward end thereof, and a plurality of slots formed in the evacuator proximate the rearward end establishing gaseous communication between the central chamber of the evacuator and the expansion chamber;

a coupling assembly carried by the outer casing proximate the rearward end thereof, the coupling assembly including a barrel receptacle having a forward end in engagement with the rearward end of the nozzle, the barrel receptacle receiving the muzzle therethrough and supporting the barrel therein, the coupling assembly further includes a support collar engaging the rearward end of the nozzle, the support collar retaining the rearward end of the evacuator assembly and the forward end of the barrel receptacle centrally within the outer casing.

16. A firearm as claimed in claim 15 wherein an expansion volume is defined between the barrel receptacle and the outer casing.

17. A firearm as claimed in claim 16 wherein the support collar includes a plurality of apertures therethrough establishing gaseous communication between the expansion chamber and the expansion volume.

* * * * *